US005935025A

United States Patent [19]

Aldstadt

[11] Patent Number: 5,935,025

[45] Date of Patent: Aug. 10, 1999

[54] COURT BOUNDARY TAPE

[76] Inventor: Jeffrey E. Aldstadt, 3353 W. Brady Ave., Anaheim, Calif. 92804

[21] Appl. No.: 09/098,028

[22] Filed: Jun. 15, 1998

Related U.S. Application Data

[63] Continuation of application No. 08/834,519, Apr. 4, 1997, Pat. No. 5,800,297.

[51] Int. Cl.[6] ..... A63B 71/00

[52] U.S. Cl. ..... 473/490

[58] Field of Search ..... 273/108.1, 282.1, 273/118 R; 473/414, 415, 472, 473, 490

[56] References Cited

U.S. PATENT DOCUMENTS

| | | |
|---|---|---|
| 1,605,662 | 11/1926 | Kayser . |
| 1,897,801 | 2/1933 | Healy . |
| 3,971,560 | 7/1976 | Panosh . |
| 3,980,299 | 9/1976 | Brown . |
| 3,985,359 | 10/1976 | Moore . |
| 4,088,317 | 5/1978 | Gierla . |
| 4,298,202 | 11/1981 | Singer . |
| 4,346,902 | 8/1982 | Warehime . |
| 5,125,669 | 6/1992 | Kanda . |
| 5,183,254 | 2/1993 | Jones . |
| 5,800,297 | 9/1998 | Aldstadt . |

OTHER PUBLICATIONS

Improvements Catalog (author unknown), Spring 1997, p. 7, Hanover, PA "Get Home–Court Advantage: Paint the "Key" Right On Your Driveway".

Item #930006, Rawlings 3 Point Basketball Chalker, Sport Fund, Inc., 1998, copies of front and back of packaging (2 pgs.).

*Primary Examiner*—Sebastiano Passaniti

*Attorney, Agent, or Firm*—Stetina Brunda Garred & Brucker

[57] ABSTRACT

A kit for forming a court upon a generally planar playing surface. In a first embodiment, the kit comprises a plurality of pieces of tapes adhesively attachable to the playing surface wherein each tape of the plurality of tape is sized and configured to correspond with and represent a specific boundary of the court. In an alternative embodiment, the kit comprises a court overlay formed from a unitary piece of tape that may be spread out about the playing surface and adhesively attached thereto to thus form a given court. The tape utilized to form the court according to the present invention may be selected to have a desired adhesive property, texture, or reflective property.

5 Claims, 2 Drawing Sheets

Fig. 1
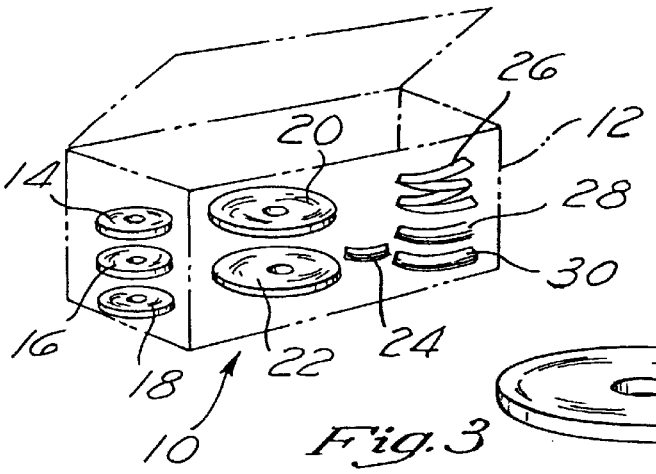
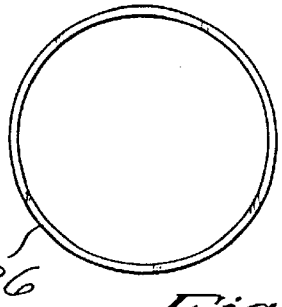
Fig. 2
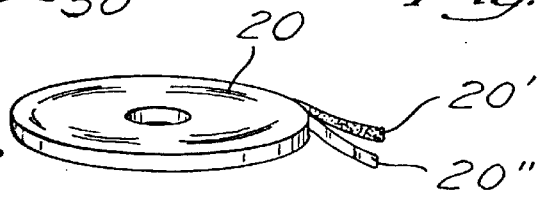
Fig. 3
Fig. 4
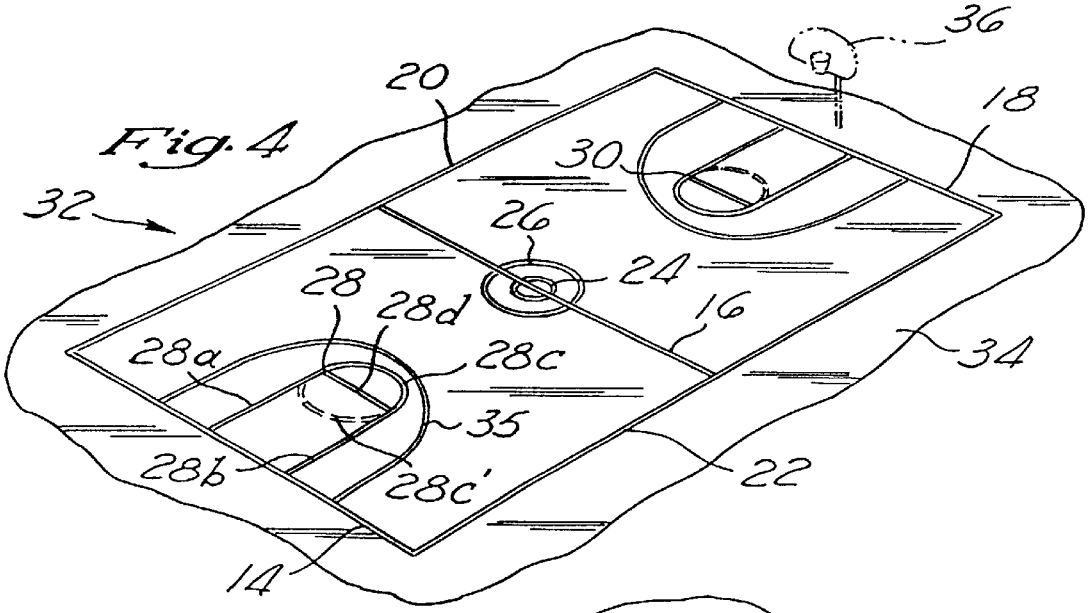
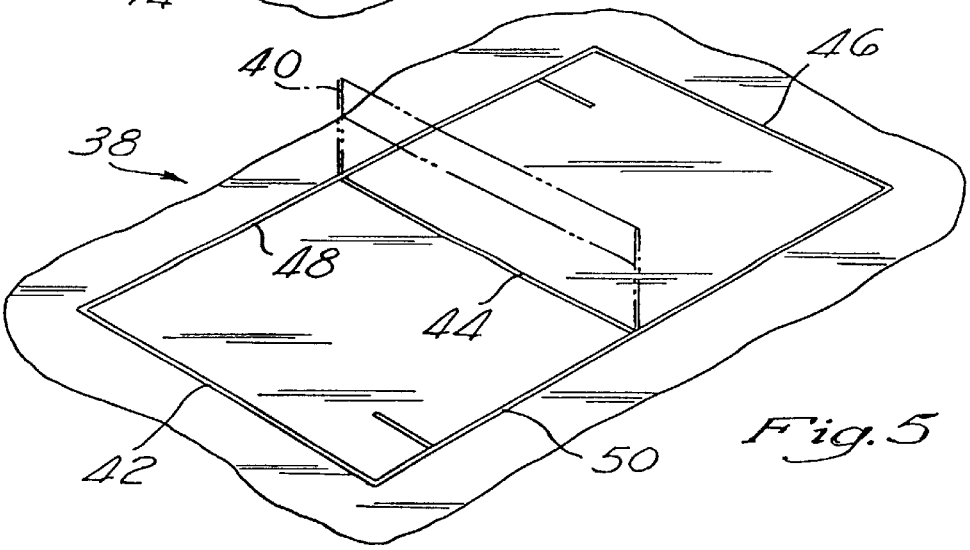
Fig. 5

COURT BOUNDARY TAPE

RELATED APPLICATION

The present application is a continuation of U.S. patent application Ser. No. 08/834,519 entitled COURT BOUNDARY TAPE filed Apr. 4, 1997 now U.S. Pat. No. 5,800,297.

FIELD OF THE INVENTION

The present invention relates generally to sporting goods equipment, and more particularly, to tape kits and tape overlays for forming a court upon a playing surface.

BACKGROUND OF THE INVENTION

Various sports played on courts, such as basketball and volleyball, are well-known and played by millions of people worldwide everyday. Advantageously, such court-based sports may typically be played indoors or outdoors and require much less playing area than other field-based sports, such as football, soccer or baseball.

In order to play a given court-based sport, however, it is necessary that the boundaries of such court be clearly identified. Otherwise, the players playing such sport will have no clear demarcation as to what is and what is not "out of bounds". Indeed, disputes among players can and do frequently arise over whether a player or ball is "in" or "out", which can thus cause great hostility and unsportsmanlike behavior and, consequently, ruin the fun and excitement of the game.

This need for clearly identified court boundaries is especially necessary in basketball where not only is there a need to identify the peripheral boundaries of the court, but also to identify other key locations on the court, such as the free throw line, three-point line, and center line, which can affect the score of the game, as well as which team is given possession of the ball. Additionally, such clearly identified boundaries and areas are necessary to enable players to properly practice shooting free throws and three-point shots as the distance from where the shot is made to the basketball hoop is the controlling factor for each such respective shot. Indeed, this need is especially compelling in light of the proliferation of portable backboard sets sold during the past few years that lack the boundaries to properly use them.

To properly mark the boundaries of a given court, however, is time consuming and requires considerable effort. In this regard, the given boundaries of a court must first be accurately measured and thereafter clearly indicated on the playing surface. The latter task is especially problematic as each line, circle or other court indicia must be accurately made on the playing surface, as with chalk or paint for example. Painting such boundaries, however, is problematic insofar as it leaves a permanent marking on the playing surface and therefore cannot be easily removed. Likewise, paint has the drawback of having to be meticulously applied (and repeatedly reapplied over time) and must further be allowed to become sufficiently dry before a game can be played thereupon. While chalk on the other hand offers the benefit of providing impermanent markings on the playing surface, as may be desired on driveways or neighborhoods where portable basketball hoops and the like are utilized, it nonetheless has the drawback of being time consuming to apply, as well as fading away rapidly as players step on and across the playing surface.

Accordingly, there is a need for a quick and accurate means of clearly identifying the boundaries of a court that: (1) can easily be put into place upon a playing surface with minimal time and effort; (2) is exceptionally durable and can withstand the movement of players moving on the playing surface; (3) can be easily and readily removed; and (4) is of simple construction and fabricated from relatively inexpensive materials.

SUMMARY OF THE INVENTION

The present invention specifically addresses and alleviates the aforementioned deficiencies in the art. In this regard, the present invention comprises a tape kit for forming a given standardized court upon a playing surface. In a first embodiment, the invention comprises a plurality of pieces of tape adhesively attachable to a planar surface, such as asphalt or concrete, that are collectively designed and adapted to be arranged in the configuration of a given court, such as a basketball court, volleyball court or street hockey rink. Essentially, each respective piece of tape is specifically sized to correspond with a specific boundary of a given court and thus be taped onto the planar surface to represent that specific boundary. In an alternative embodiment, the invention comprises a tape overlay formed from a unitary piece of tape having the dimensions of a given court that may be spread out upon a planar surface and adhesively attached thereto. In either embodiment, the tape utilized to form the court may be selected to have properties that enable the tape to be either more easily removed from or more permanently affixed to the playing surface, or have a desired texture, thickness or reflective property. Additionally, in either embodiment, the tape kits may include measuring devices or indicia formed upon the tape to assist the consumer in laying out and applying the same to the playing surface.

It is therefore an object of the present invention to provide a tape kit for forming a court upon a playing surface that can easily be put into place and readily played thereupon.

Another object of the present invention is to provide a tape kit that may be utilized to form any one of a variety of courts including, but not limited to, a basketball court, volleyball court, street hockey rink, squash court, badminton court, handball court, racquetball court or tennis court.

A still further object of the present is to provide a tape kit for forming a court that is of simple construction, inexpensive to manufacture, may be selectively made to be either easily removable from or permanently affixed to a given playing surface, selectively chosen to have a desired texture and/or reflective property, and is exceptionally durable and can withstand heavy foot traffic, automobiles, adverse weather, and the like.

BRIEF DESCRIPTION OF THE DRAWINGS

These, as well as other features of the present invention, will become more apparent upon reference to the drawings, wherein:

FIG. 1 is a perspective view of a tape kit having a plurality of pieces of tape therein for forming a basketball court according to a preferred embodiment of the present invention;

FIG. 2 is a side view of a piece of tape of the plurality of tapes depicted in FIG. 1 assuming an unfolded, circular configuration;

FIG. 3 is a perspective view of a roll of tape of the plurality of pieces of tape of FIG. 1 having a peel off strip formed on the backing thereof;

FIG. 4 is a perspective view of a basketball court formed from the tape kit depicted in FIG. 1;

FIG. 5 is a perspective view of a volleyball court formed from a tape kit according to a preferred embodiment of the present invention.

DETAILED DESCRIPTION OF THE PREFERRED EMBODIMENT

Figure 6:
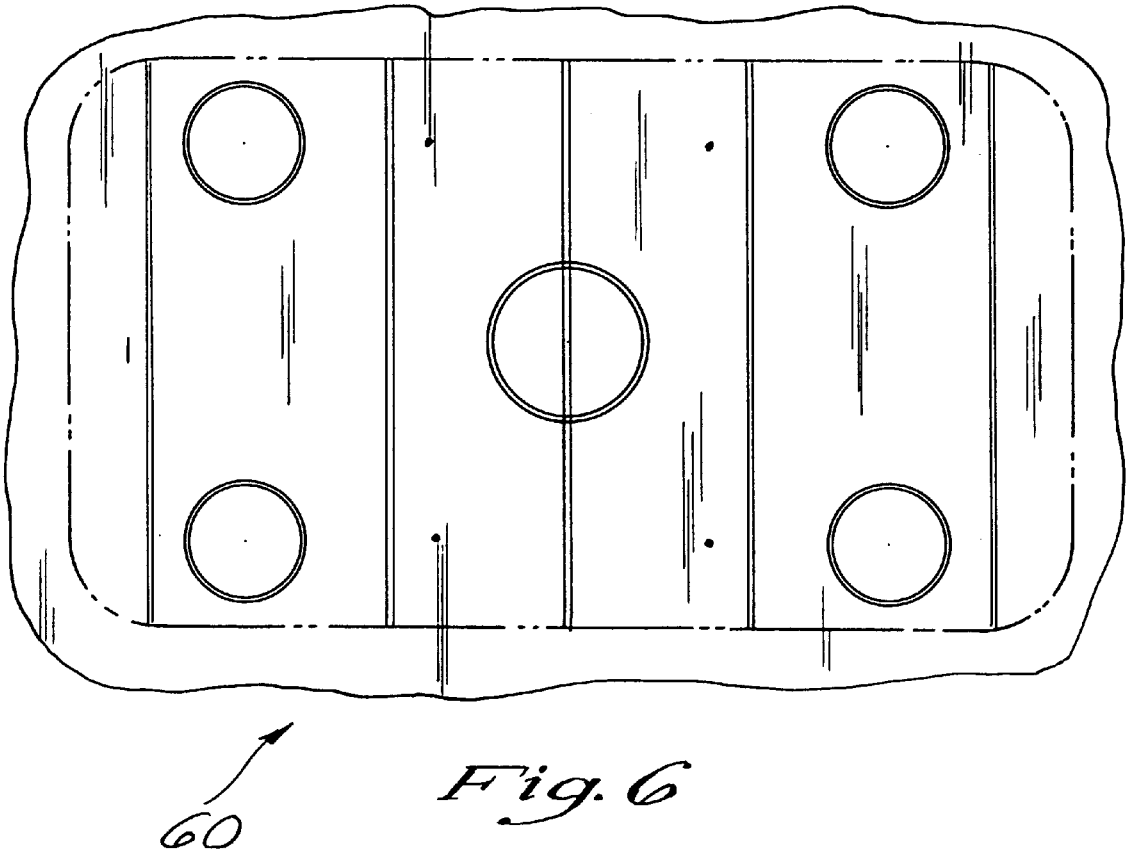
FIG. 6 is a top view of a street hockey rink formed from a tape kit according to a preferred embodiment of the present invention.

The detailed description set forth below in connection with the appended drawings is intended merely as a description of the presently preferred embodiments of the invention, and is not intended to represent the only forms in which the present invention may be constructed or utilized. The description sets forth the functions and sequence of steps for constructing and implementing of the invention in connection with the illustrated embodiments. It is to be understood, however, that the same or equivalent functions and sequences may be accomplished by different embodiment(s) that are also intended to be encompassed within the spirit and scope of the invention.

Referring now to the drawings, and initially to FIG. 1, there is shown a court boundary tape kit 10 according to a first preferred embodiment. The kit 10 comprises a plurality of pieces of tape, such as pieces 14–30, that are preferably initially packaged within a container 12 or other like package. The plurality of pieces of tape 14–30 are specifically designed and accurately dimensioned to be collectively arranged in the configuration of a specific court wherein each respective piece of tape 14–30 will be formed and sized to correspond with and represent a specific boundary of that particular court.

In order for the various pieces of tape to accurately assume the configuration of a given court, it will be recognized that such pieces of tape comprising the plurality of tapes will consist of both elongate segments, as well as possibly other geometric shapes, such as circularly configured tape piece 26 depicted in FIG. 2. It should additionally be recognized that each tape kit 10 of the present invention will preferably be packaged such that the plurality of pieces of tape provided therewith will be specific to a particular type of court, which may include but by no means be limited to courts for basketball, volleyball, street hockey such as 60, depicted in FIG. 6, tennis, racquetball, squash, badminton and/or handball. As such, the present invention contemplates that there will be a specific tape kit for forming a basketball court, a separate kit for forming a volleyball court, a separate kit for forming a street hockey rink, and so on. Moreover, it is further contemplated that such kits may even be specific for only a portion of a court, such as one-half of a full length basketball court, to thus conserve playing surface space. As such, each kit may provide greater or fewer pieces of tape as is necessary to form a given court.

Each piece of the plurality of pieces of tape, such as 20 depicted in FIG. 3, is provided with an adhesive backing to enable each piece to be securely attached (i.e., taped) to a given playing surface. To provide for easier installation, it will be recognized that the tape utilized may be provided with a peel away strip backing 20' that may be selectively removed from the tape 20" as the tape is applied to the playing surface, as discussed below. As will be recognized by those skilled in the art, the specific type of tape utilized to form the courts according to the present invention may be selectively chosen to have a desired adhesive quality, so as to enable the tape to more permanently adhere to a playing surface or, alternatively, enable the tape to be more easily removed from a given surface at a later time. Additionally, such tape may be selectively chosen to have a desired reflective property to best enable the boundaries of the court formed thereby to be more easily seen. As will be appreciated, selecting a tape having an enhanced reflective property will advantageously allow the court formed by the tape kit of the present invention to be more easily and readily seen by oncoming cars in those instances where the tape kit 10 of the present invention is utilized to form a court on a street or other area situated in close proximity to traffic and moving vehicles.

At present, because it is contemplated that the tape utilized to form the court according to the present invention will most likely be applied to surfaces such as asphalt or concrete, it is believed that among the types of commercially available tape best suited for such applications include certain single-coated industrial tapes produced by 3M, including vinyl/rubber tape number 471 and plastic/rubber tape number 4746. Each such tape is particularly well suited for the applications stated herein as each type of tape provides sufficient adhesive properties, good visibility, and sufficient durability to withstand persistent and aggressive foot traffic, automobiles, and inclement weather such as rain, etc. Moreover, it should further be recognized by those skilled in the art that to the extent necessary, prior to attaching the court boundary tape of the present invention to a given playing surface, it may be necessary to apply a tape primer to the playing surface or otherwise prepare the playing surface to thus enhance the ability of the tape to adhesively adhere thereto. As is well known to those skilled in the art, the use of a tape primer, such as 3M 81 tape primer, may be utilized for increasing the bond of pressure-sensitive tapes.

In an alternative embodiment not shown, the tape kit will consist of a unitary piece of tape formed as an overlay for a court that may be adhesively attached to a generally planar playing surface. In this regard, such embodiment contemplates that the tape will be formed by fastening segments of tape together to thus form the resultant overlay. Alternatively, the overlay may be formed by selectively cutting out a unitary piece of tape in the configuration of a specific type of court. As will be recognized, such methods of fabricating a court overlay according to the second embodiment of the present invention may be achieved by methods well known to those skilled in the art.

Referring now to FIGS. 4 and 5, and initially to FIG. 4, there is shown a basketball court 32 as formed by the tape kit 10 depicted in FIG. 1. As illustrated, there is provided at the outset a generally planar playing surface 34 upon which the pieces of tape 14–30 are attached. The orientation of the court will then be selected such that the court ultimately formed by the various pieces of tape will be properly aligned with a basketball backboard with hoop 36. As will be recognized, the kit 10 may preferably include one or more conventional measuring devices, such as a pre-measured string, measuring tape, and the like, to aid in the proper formation and orientation of the court. Likewise, the tape utilized to form the court may have indicia formed thereon to assist the user to form the court in the proper orientation.

Thereafter, the various pieces of tape will be arranged in the configuration of the basketball court 32 as shown. Specifically, tape pieces 14 and 18, respectively, will be positioned and adhesively attached to playing surface 34 to thus represent the first and second end lines, respectively. Similarly, tape piece 16 will be positioned and attached to the surface 34 to thus form the center line. Tape piece 24 will be unraveled from its folded state, as depicted in FIG. 1, to assume its circular configuration whereby the same will then be positioned upon the center line to thus form the center circle 24. Tape piece 26 will then be positioned axially about center circle 24, to thus form a restricting circle 26. Tape pieces 28 and 30 may then be selectively positioned and attached to playing surface 34 to thus form the keys of the court, the former being formed and defined by tape segments 28*a*, 28*b* and free throw line 28*d*. Tape pieces 28 and 30 may additionally be provided with annular tape portions, such as 28*c*, 28*c'*, to further enhance the ability of the tape kit 10 to more accurately conform to and assume the appearance of a conventional basketball court. With respect to the latter, it will be recognized by those skilled in the art that tape segments 28*c*, 28*c'* may preferably be integrally formed with tape piece 28 or, alternatively, be formed to have a generally annular shape and attached to the playing surface 34 in the manner and orientation shown.

The kit may further include a tape piece 35 for indicating the range from where 3-point shots may be made. Likewise, it should be recognized that such kit may be modified to provide shorter side lines 20, 22 and only one of tape pieces 28 or 30 to thus form only a half court should it be desired.

Although not shown, the basketball court 32 depicted in FIG. 4 may likewise be formed from the tape kit according to the second preferred embodiment simply by spreading out the overlay upon the playing surface 34 and orienting the same such that the resultant court formed thereby will be aligned with backboard and hoop 36. Thereafter, the tape backing may be removed from the overlay where the overlay may thus become adhesively attached to the playing surface.

Similarly, in FIG. 5, there is depicted a volleyball court 38 formed from a tape kit (not shown) according to the first embodiment of the present invention. As illustrated, there is initially provided a playing surface and volleyball net 40 about which the volleyball court 38 is formed. As discussed above, a separate tape kit will be utilized to form such a volleyball court and hence, there will be provided a separate and distinct plurality of tapes that are specifically designed and adapted to be arranged in a configuration of a volleyball court. Specifically, tape pieces 42, 46 will be aligned to form the first and second end lines, respectively, as shown. Center line 44 may then be applied to extend longitudinally beneath the length of volleyball net 40. First and second side lines may then be formed by tape pieces 48, 50, respectively. As a result, there will thus be formed a volleyball court upon a playing surface having accurate and clearly identified boundaries to thus enable a game to be readily and correctly played thereon.

What is claimed is:

1. A tape kit for forming one-half of a basketball court about a basketball hoop and backboard upon a planar surface comprising an overlay having a multiplicity of elongate and arcuate tape pieces that are designed and configured to be adhesively attached to said planar surface, said multiplicity of tape pieces being designed and adapted to be arranged in the configuration of said one-half of said basketball court such that said multiplicity of tape pieces correspond and represent the sidelines, endline, and key of said one-half of said basketball court when said overlay is adhesively attached to said planar surface.

2. The tape kit of claim 1 wherein said multiplicity of tape pieces further correspond to represent the three-point shot line of said one-half of said basketball court when said overlay is adhesively attached to said planar surface.

3. A tape kit for forming one-half of a basketball court about a basketball hoop and backboard upon a planar surface comprising an overlay having a multiplicity of elongate and arcuate tape pieces that are designed and configured to be adhesively attached to said planar surface, said multiplicity of tape pieces designed and adapted to be arranged in the configuration of said one-half of said basketball court such that said multiplicity of tape pieces correspond and represent the endline, key and three-point shot line of said one-half of said basketball court when said overlay is adhesively attached to said planar surface.

4. A tape kit for forming one-half of a basketball court about a basketball hoop and backboard upon a planar surface comprising an overlay having a multiplicity of elongate and arcuate tape pieces that are designed and configured to be adhesively attached to said planar surface, said multiplicity of tape pieces being designed and adapted to be arranged in the configuration of said one-half of said basketball court such that said multiplicity of tape pieces correspond to and represent the key and three-point shot line of said one-half of said basketball court when said overlay is adhesively attached to said planar surface.

5. A tape kit for forming the key of a basketball court about a basketball hoop and backboard upon a planar surface comprising an overlay having a multiplicity tape pieces that are designed and configured to be adhesively attached to said planar surface, said multiplicity of tape pieces being designed and adapted to be arranged in the configuration of said key of said basketball court such that said multiplicity of tape pieces correspond to and represent the sides, free-throw line and semicircle arch of said key of said basketball court when said overlay is adhesively attached to said planar surface.

* * * * *